US009217262B1

(12) United States Patent
Gilmore

(10) Patent No.: US 9,217,262 B1
(45) Date of Patent: Dec. 22, 2015

(54) KEY AND LOCK IDENTIFICATION SYSTEM

(71) Applicant: Matt Gilmore, Perry, IA (US)

(72) Inventor: Matt Gilmore, Perry, IA (US)

( * ) Notice: Subject to any disclaimer, the term of this patent is extended or adjusted under 35 U.S.C. 154(b) by 0 days.

(21) Appl. No.: 14/623,669

(22) Filed: Feb. 17, 2015

Related U.S. Application Data

(60) Provisional application No. 62/035,879, filed on Aug. 11, 2014.

(51) Int. Cl.

| | |
|---|---|
| ***G09F 15/00*** | (2006.01) |
| ***E05B 19/24*** | (2006.01) |
| ***A44B 15/00*** | (2006.01) |
| ***A44B 11/26*** | (2006.01) |
| ***G09F 3/00*** | (2006.01) |

(52) U.S. Cl.
CPC ..... *E05B 19/24* (2013.01); *A44B 11/26* (2013.01); *A44B 15/00* (2013.01); *G09F 3/00* (2013.01)

(58) Field of Classification Search
CPC ..... A44B 15/002
USPC ..... 40/330, 634; 70/459, 460; 24/615
See application file for complete search history.

(56) References Cited

U.S. PATENT DOCUMENTS

| | | | | |
|---|---|---|---|---|
| 3,979,934 | A * | 9/1976 | Isenmann | 70/459 |
| 5,069,050 | A * | 12/1991 | Chen | 70/456 R |
| 5,927,116 | A * | 7/1999 | Emoff | 70/456 R |
| 6,000,258 | A * | 12/1999 | Lesko | 70/460 |
| 6,553,637 | B1 * | 4/2003 | Chen | 24/614 |

* cited by examiner

*Primary Examiner* — Joanne Silbermann
(74) *Attorney, Agent, or Firm* — Zarley Law Firm, P.L.C.

(57) ABSTRACT

The present invention relates to a key and lock identification system. The key and lock identification system includes a first identification member connected to a second identification member. The first identification member and the second identification member have associated identifiers such as a color, a letter, a word, or a symbol that is identical or related.

17 Claims, 2 Drawing Sheets

KEY AND LOCK IDENTIFICATION SYSTEM

CROSS REFERENCE TO RELATED APPLICATION

This application claims the benefit of U.S. Provisional Application No. 62/035,879 filed Aug. 11, 2014.

BACKGROUND OF THE INVENTION

This invention is directed to a system for matching a key with an associated lock. More particularly, this invention is directed to a system for identifying from multiple keys a specific key associated with a specific lock.

Individuals, such as home owners, often use a plurality of locks that are opened through the use of a key or combination. For many, when locks are not used on a frequent basis, keys are placed in a drawer with a number of other keys. Over time, without use, it becomes difficult to remember which key or combination goes with each lock.

In addition, some locks, such as a lock for a bicycle, are used in transit. Once the bike is locked, the key is placed in a pocket where it can easily be lost. Accordingly, based on these problems, a need exists in the art for a device that addresses these needs.

Therefore, an objective of the present invention is to provide a system where a key for a specific lock is quickly and easily identified.

Another objective of the present invention is to provide a system for securing a key for a lock while in transit.

These and other objectives will be apparent to one of ordinary skill in the art based upon the following written description.

SUMMARY OF THE INVENTION

Figure 1:
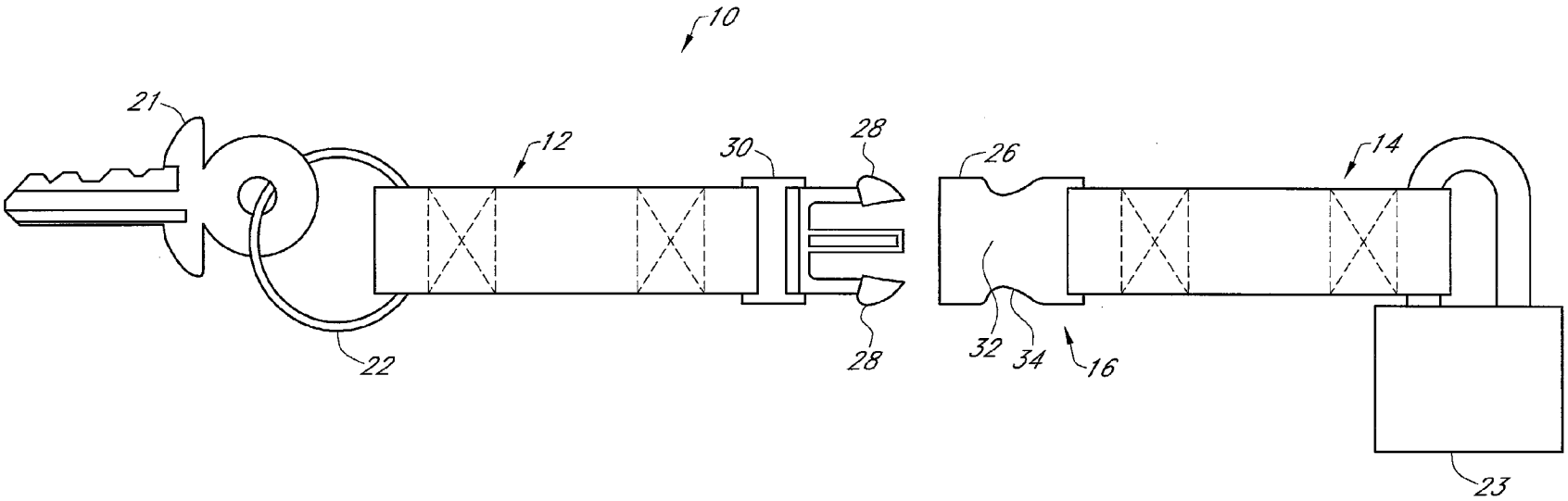
FIG. 1 is a top view of a key and lock identification system.
Figure 2:
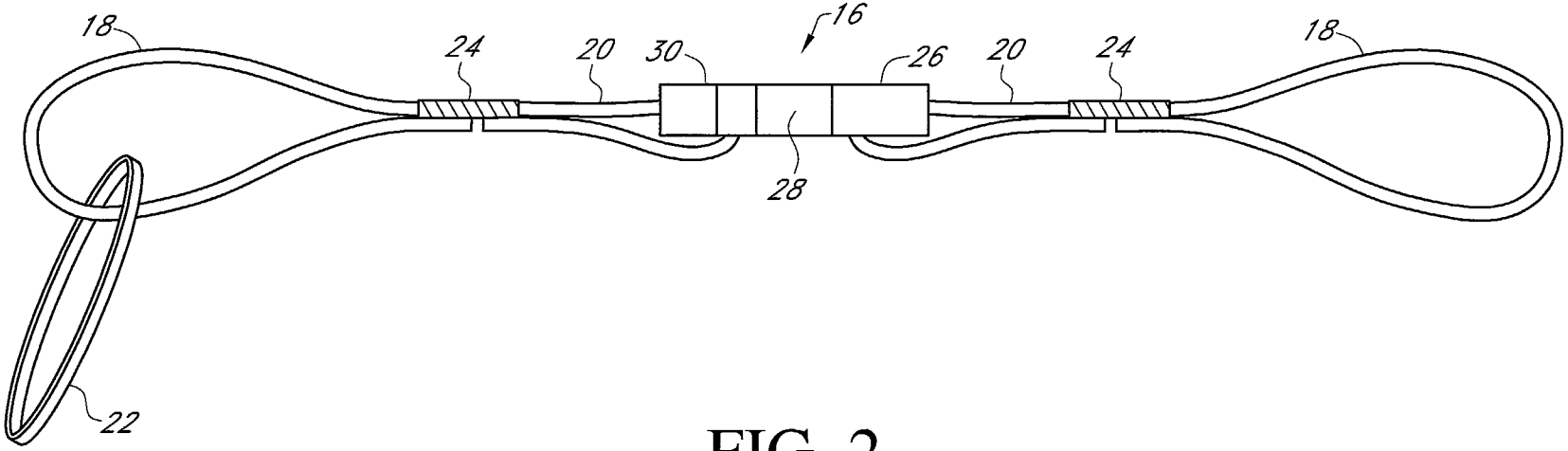
FIG. 2 is a side view of a key and lock identification system.

The present invention related to a key and lock identification system. The present invention relates to a key and lock identification system. The key and lock identification system includes a first identification member connected to a second identification member. The first identification member and the second identification member have associated identifiers such as a color, a letter, a word, or a symbol that is identical or related.

The associated identifier is integrated directly into the first and second identification members. Alternatively, the associated identifiers are a separate body that is attached to or wrapped around the first and second identification members. The associated identifiers are removable.

DETAILED DESCRIPTION OF THE PREFERRED EMBODIMENTS

Referring to the Figures, a key and lock identification system 10 includes a first identification member 12 connected to a second identification member 14 by a fastening member 16. The first and second identification members 12 and 14 are of any size, shape, and/or structure and preferably are comprised of an elongated strap wherein the ends are folded over and attached to the strap to form an end loop 18 and a fastening loop 20. The ends 18 and 20 are attached in any conventional manner such as stitching, glue, or the like.

The end loop 18 of the first identification member 12 receives a key 21 either directly or in association with a key ring 22. The end loop 18 of the second identification member 14 receives a lock 23. The first and second identification members 12 and 14 have an associated identifier 24 which can be a color, letters, word, and/or symbol that are identical or related to one another. The associated identifier 24 in one embodiment is part of the design of the first and second identification members 12 and 14. Alternatively, the associated identifier 24 is attached to or around the first and second identification members 12 and 14. In one arrangement, the associated identifier 24 is removable.

The fastening member 16 is of any size, shape, and/or structure. In one example the fastening member 16 has a first section 26 having compressible prongs 28 and a second section 30 having a cavity 32 and side openings 34 that receives the prongs 28.

In operation a key 21 is connected to the first identification member 12 and a lock 23 is attached to the second identification member 14. When the lock 23 is in use the first identification member 12 is detached from the second identification member 14. In the example above the prongs 28 are compressed toward one another with manual force through the side openings 34 such that the prongs 28 are slideably removed from the cavity 32.

Once removed the key 21 with attached identification member 12 is stored or attached to a backpack or article of clothing using the fastening member. When the time comes to unlock the lock 23 the associated key 21 is easy to identify by comparing the identifier 24 on the first and second identification members 12 and 14.

Therefore, a key and lock identification system 10 has been disclosed that is quickly and easily identified, provides a system that is secure while in transit, and improves upon the state of the art.

From the above discussion and accompanying figures and claims it will be appreciated that the key and lock identification system 10 offers many advantages over the prior art. It will also be appreciated by those skilled in the art that other modifications could be made without parting from the spirit and scope of the invention and fall within the scope of the claims and are intended to be covered thereby.

What is claimed is:

1. A key and lock identification system comprising:

a first identification member connected to a second identification member by a fastening member;

the first identification member and the second identification member having associated identifiers;

a fastening loop at the ends of the first identification member and the second identification member;

end loops at the opposite ends of the first identification member and the second identification member;

a key received on the end loop of the first identification member and a lock received on the end loop of the second identification member.

2. The key and lock identification system of claim 1 further comprising a key ring received on the end loop of the first identification member.

3. The key and lock identification system of claim 1 wherein the associated identifiers are colors.

4. The key and lock identification system of claim 1 wherein the associated identifiers are letters.

5. The key and lock identification system of claim 1 wherein the associated identifiers are words.

6. The key and lock identification system of claim 1 wherein the associated identifies are symbols.

7. The key and lock identification system of claim 1 wherein the associated identifiers are identical to one another.

8. The key and lock identification system of claim 1 wherein the associated identifiers are related to one another.

9. The key and lock identification system of claim 1 wherein the associated identifiers are removable.

10. The key and lock identification system of claim 1 wherein the associated identifiers wrap around the first and second identification members.

11. The key and lock identification system of claim 1 further comprising the fastening member having a first section having compressible prongs and a second section having a cavity and side openings that receive the prongs of the first section.

12. A key and lock identification system comprising:

a first identification member extending a length between a first end and a second end and having an identifier;

a second identification member extending a length between a first end and a second end and having an identifier;

the first end of the first identification member connected to a fastening member, and the first end of the second identification member connected to a fastening member, such that the first identification member and the second identification member are selectively engaged and disengaged from one another by the fastening member;

a key connected to the second end of the first identification member;

a lock connected to the second end of the second identification member.

13. The key and lock identification system of claim 12, further comprising a key ring connected to the second end of the first identification member and the key connected to the key ring.

14. The key and lock identification system of claim 12, wherein the identifier is selected from the group consisting of: colors, letters, words and symbols.

15. The key and lock identification system of claim 12 wherein the fastening member has a first section and a second section that engage one another in mating fashion.

16. A key and lock identification system comprising:

a first identification member extending a length between a first end and a second end and having an identifier;

a second identification member extending a length between a first end and a second end and having an identifier;

the first end of the first identification member connected to a fastening member;

the first end of the second identification member connected to a fastening member;

wherein the first identification member and the second identification member are selectively engaged and disengaged from one another by the fastening member;

an end loop on the second end of the first identification member;

an end loop on the second end of the second identification member;

a key connected to the second end of the first identification member;

a lock connected to the second end of the second identification member.

17. The key and lock identification system of claim 12, wherein the identifier is selected from the group consisting of: colors, letters, words and symbols.

* * * * *